United States Patent [19]

DeCicco et al.

[11] Patent Number: 4,746,290

[45] Date of Patent: May 24, 1988

[54] METHOD AND APPARATUS FOR TREATING WASTE CONTAINING ORGANIC CONTAMINANTS

[75] Inventors: Steven G. DeCicco, Knoxville; Sung K. Lee, Clinton; Rudy G. Novak, Knoxville; William E. Wass; Kai K. Mak, both of Concord, all of Tenn.

[73] Assignee: International Technolgy Corporation, Knoxville, Tenn.

[21] Appl. No.: 869,200

[22] Filed: May 29, 1986

[51] Int. Cl.[4] ..... F27D 7/00

[52] U.S. Cl. ..... 432/19; 432/105; 432/106; 432/109; 432/111

[58] Field of Search ..... 432/103, 105, 109, 111, 432/113, 115, 117, 19

[56] References Cited

U.S. PATENT DOCUMENTS

| | | | |
|---|---|---|---|
| 1,216,667 | 2/1917 | Downs | 432/109 |
| 1,731,898 | 10/1929 | Heine | 432/111 |
| 1,754,854 | 4/1930 | Gelstharp | 432/111 |
| 1,904,781 | 4/1933 | Crawford | 432/105 |
| 2,049,734 | 8/1936 | Fasting | 432/109 |
| 2,590,090 | 3/1952 | De Vaney | 432/106 |
| 2,654,592 | 10/1953 | Harris | 432/109 |
| 3,087,715 | 4/1963 | Dailey, Jr. | 432/111 |
| 3,488,700 | 1/1970 | Iken et al. | 432/111 |
| 4,171,950 | 10/1979 | Bliemeister | 432/105 |
| 4,338,868 | 7/1982 | Lientz | 432/115 |

*Primary Examiner*—Henry C. Yuen

*Attorney, Agent, or Firm*—Luedeka, Hodges & Neely

[57] ABSTRACT

A system including a method and apparatus for treating waste containing organic contaminants which includes a direct fired, countercurrent, rotary kiln providing a soaking zone having an oxidizing atmosphere through which the materials being treated are passed after the unwanted organics are removed, and a secondary combustion chamber for oxidizing gases containing vaporized or pyrolyzed organics in which the organics are burned and are subjected to high temperatures for a holding time sufficient to effect destruction of the organic contaminants. The system includes means to minimize off-gas so as to make possible a reduction in size of the equipment employed.

3 Claims, 7 Drawing Sheets

METHOD AND APPARATUS FOR TREATING WASTE CONTAINING ORGANIC CONTAMINANTS

The present invention relates generally to a system which includes methods and apparatus for treating waste materials containing organic contaminants and, more particularly, to a system for thermally treating waste containing organic contaminants of widely varying types and in widely varying amounts.

Much effort has been directed to cleaning up hazardous wastes in the drive to improve the environment. Much of the hazardous waste contains organic components including one or more of the contaminants defined in the Resource Conservation and Recovery Act and the Toxic Substances Control Act or other organic materials with toxic, carcinogenic, or other hazardous properties. Examples of wastes having hazardous properties are such materials as tars, polychlorinated biphenyls, dioxin, kepones, etc. These materials require a broad range of treatment conditions to assure destruction. The materials are found in soil, sludge, ponds, in equipment, building structures and the like. Thus, it is necessary for processes to be employed which will effect destruction of the hazardous organics from a wide variety of matrices.

Processes have been employed which involve a thermal treatment or burning to destroy organic contaminants. However, the equipment and conditions for destruction are complex and most of the processes are directed to the destruction of a particular category of contaminants.

Because the matrices, contaminants and the relative proportions of contaminate to matrix vary from site to site, there is a need for a system which can process a variety of contaminants in varying amounts in various base matrices with the same equipment and system through the adjustment of process parameters. Moreover, it is desirable that the system be capable of utilizing the fuel values of the organic materials so as to minimize auxiliary fuel expenses for the system. Finally, it is desirable to have a system which is capable of being broken down into transportable modules so that it can be transported to and erected at a contaminated site.

Accordingly, it is the principal object of this invention to provide a thermal treatment system for hazardous waste containing organic contaminants which is economical in operation and which is adaptable for the processing of a wide variety of matrices containing a wide variety of organic contaminants.

Another object of the invention is a provision of a system of the class described which is capable of evaporating and decontaminating contaminated liquid wastes as well as any contaminated purge water produced in the system.

A further object of the invention is the provision of a system of the class described which includes equipment which can be readily broken down into modules for mobility which modules can then be transported to contaminated sites as required.

A specific object of the invention is the provision of an improved rotary kiln construction which is direct fired with counterflow material feed and which can provide both oxidative and reductive atmospheres.

A more specific object of the invention is a method of operating a rotary kiln to maximize through-put and to minimize off-gas volume in the treatment of hazardous organic wastes.

A further specific object of the invention is the provision of a rotary kiln construction which minimizes the amount of particulates in the off-gas.

Another specific object of the invention is the provision of apparatus for treating gases and liquids at elevated temperatures to decompose hazardous organic wastes contained therein. Other objects and advantages of the invention will become known by reference to the following description and the accompanying drawings in which.

Figure 1:
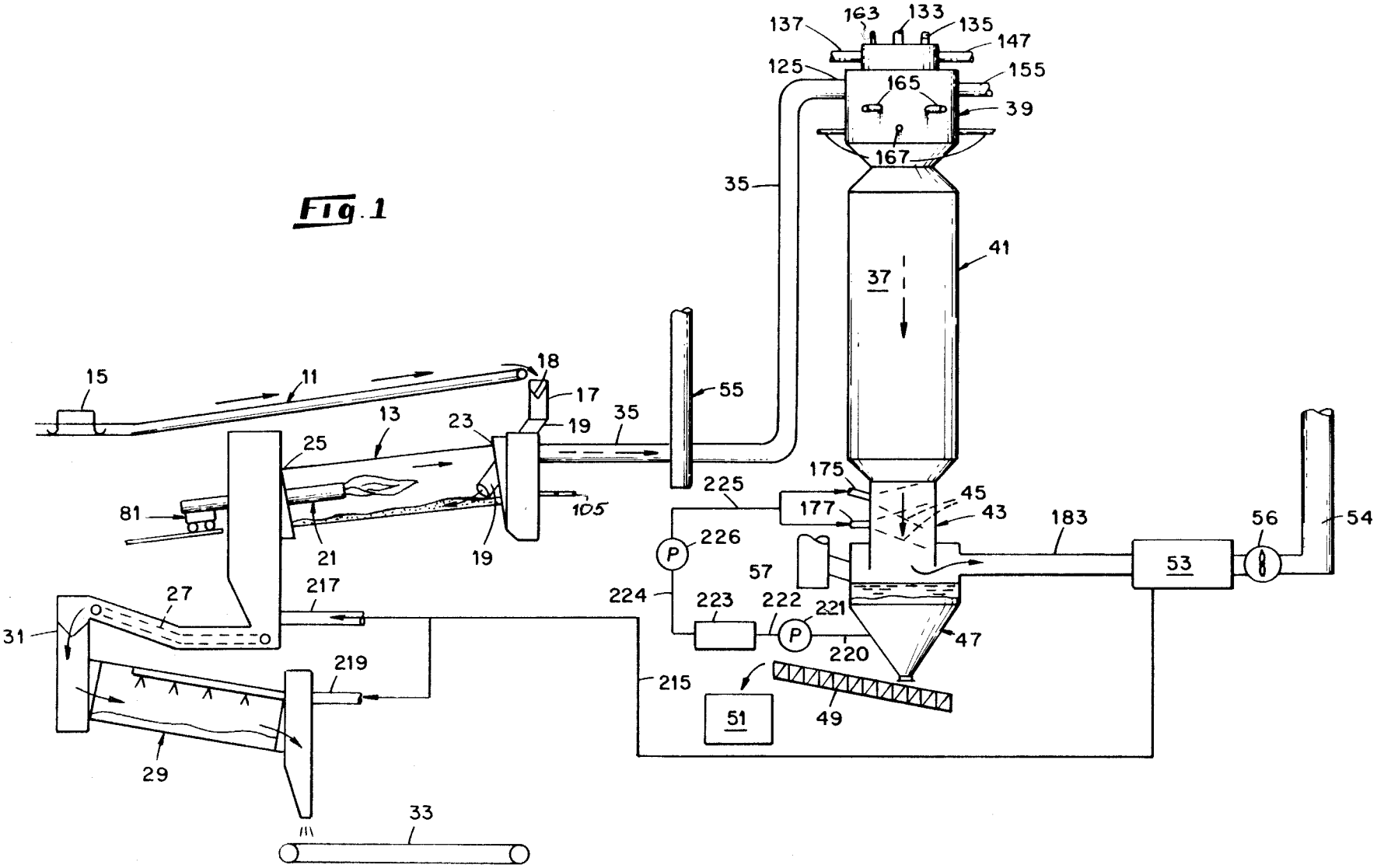
FIG. 1 is a diagrammatic flow sheet of a system embodying various of the features of the invention.
Figure 6B:
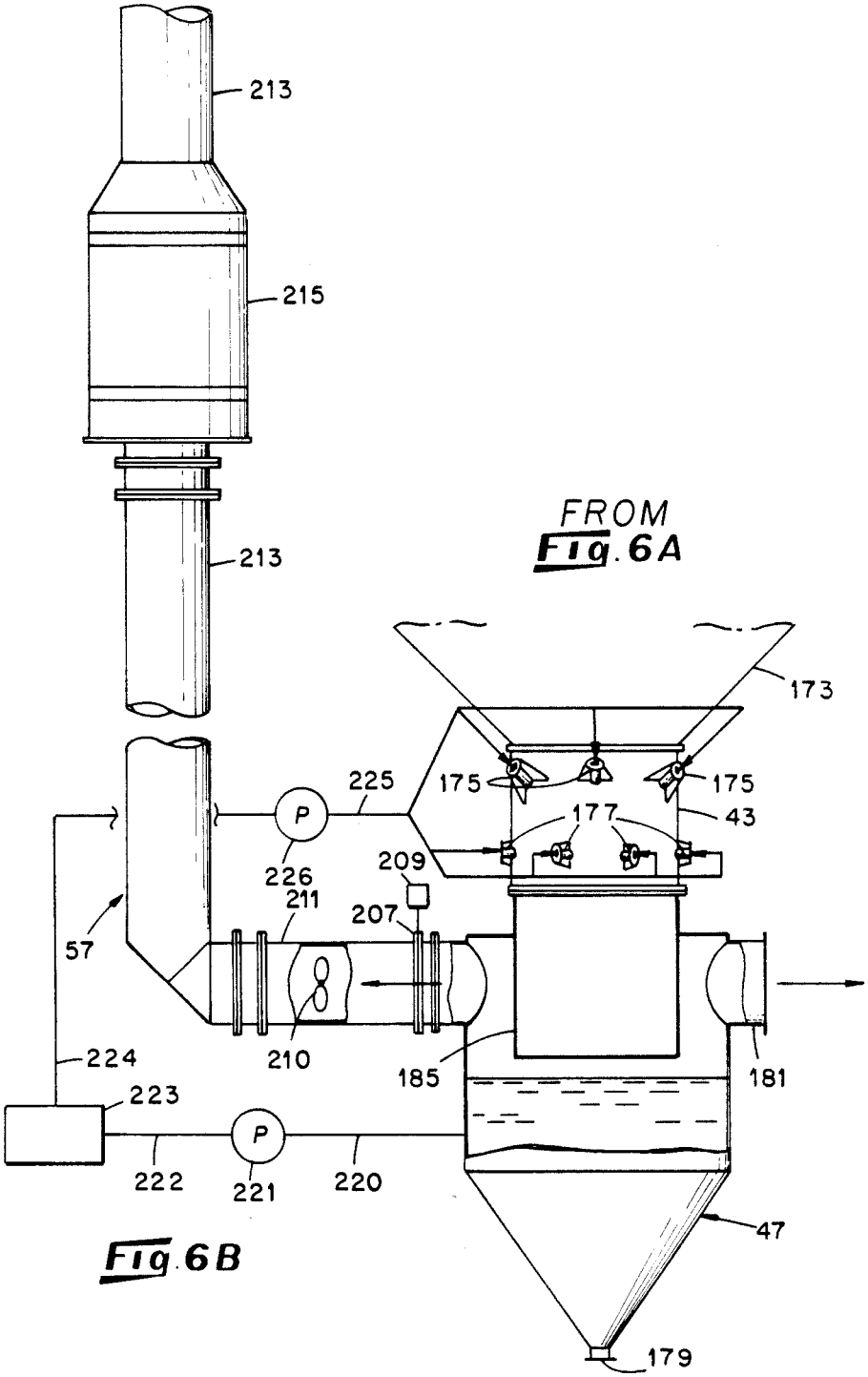
Figure 6A:
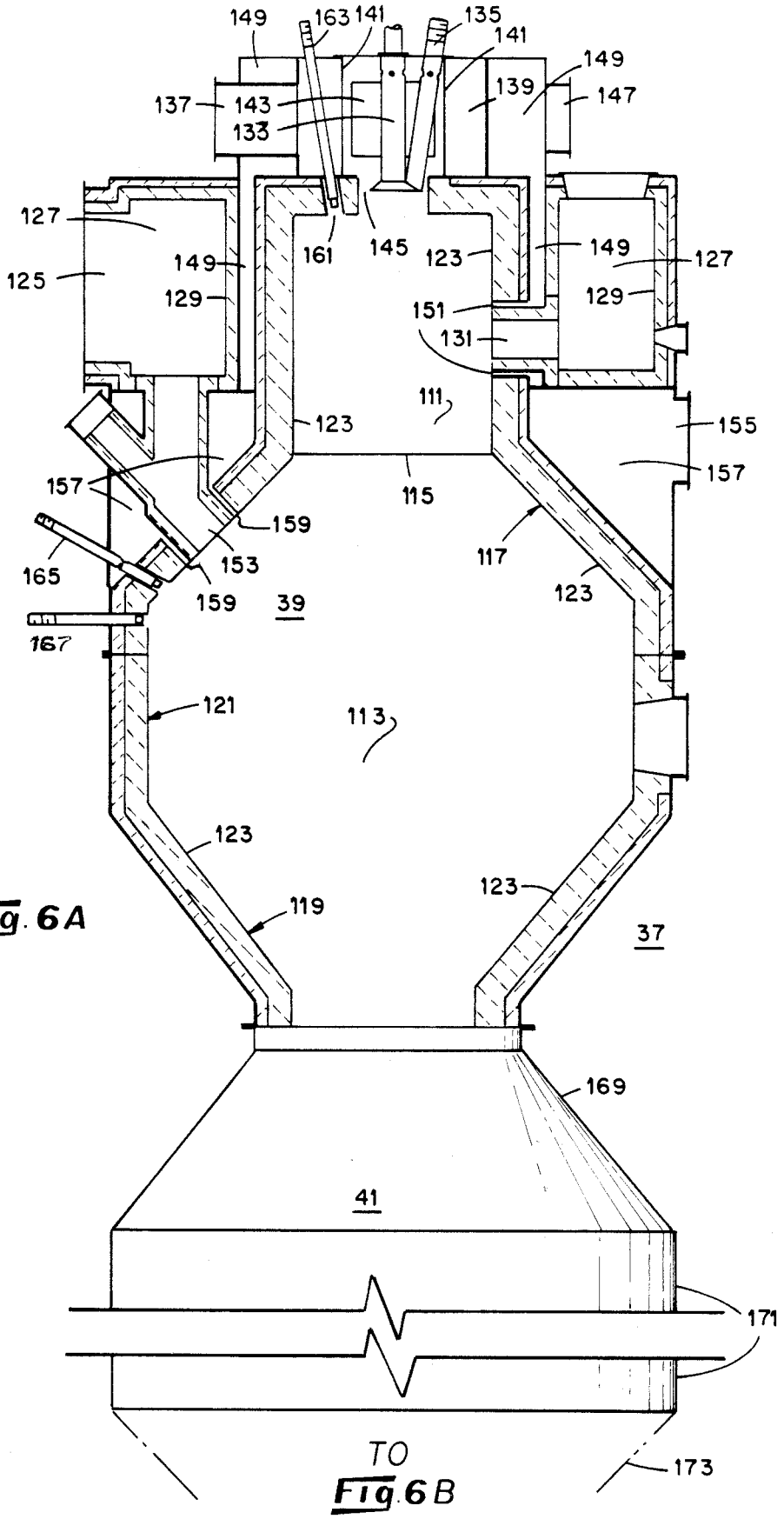
Figure 7:
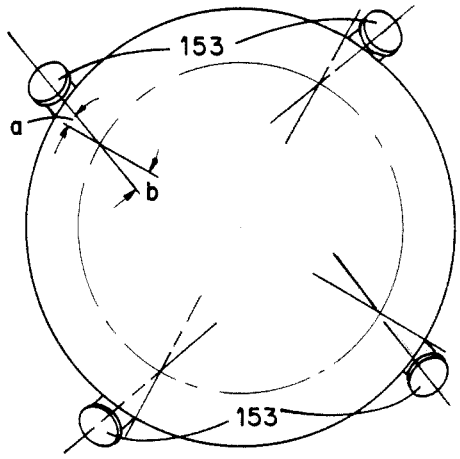
Figure 8:
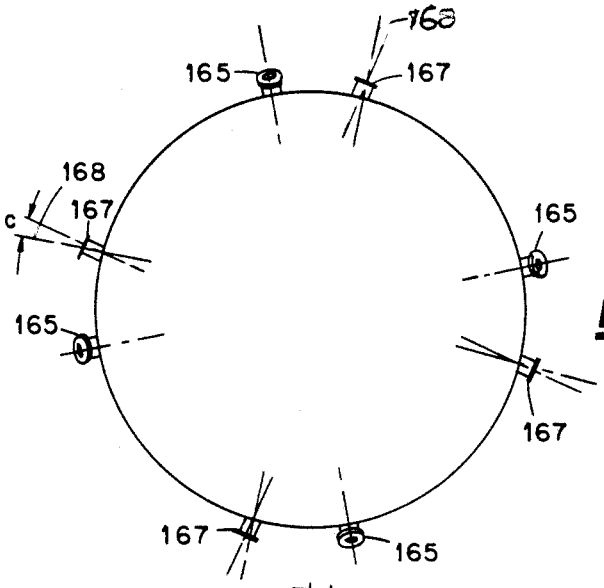
Figure 9:
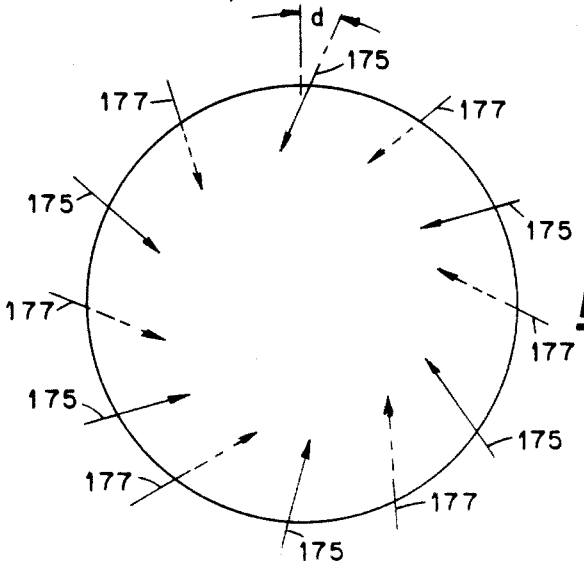

FIGS. 6A and 6B together form an elevational view, partially in section, showing a secondary combustion unit for treating gases and liquids and which forms a part of the system illustrated in FIG. 1;

FIG. 7 is a diagrammatic view showing the orientation of the down draft burners which form a part of the secondary combustion unit of FIG. 6;

FIG. 8 is a diagrammatic view showing the orientation of quench water and liquid waste injectors which form a part of the secondary combustion unit illustrated in FIG. 6; and FIG. 9 is a diagrammatic view showing the orientation of water spray nozzles which are employed in cooling the hot gases produced in the secondary combustion unit illustrated in FIG. 6.

Before describing the specific construction of various of the important pieces of equipment in the system, the system and its general operation will be described to facilitate an understanding of the importance of various of the specific features. With reference to FIG. 1, the material or matrix containing the hazardous organics which are to be treated in the system is broken up to reduce it to pieces having a maximum dimension of approximately two inches so that they will be in a condition to permit the unwanted organics to be more readily desorbed, pyrolyzed and/or converted to the gaseous state. This can be accomplished with any known equipment such as shredders, hammermills or the like.

The sized material is fed by a conveyor 11 to a countercurrent, direct fired rotary kiln 13. In order that the rate of feed may be closely controlled to maintain the material in the kiln for the desired period of time, a belt scale 15 is provided to monitor the rate of feed. The material is fed from the conveyor through a hopper 17 and conduit 19 into the kiln 13. The hopper 17 includes a flap valve or the like 18 to minimize the ingress of air since the system is maintained at a slightly negative pressure relative to the atmosphere and to permit control of the atmosphere in the system. Thus, in the event that any seals develop leaks, the contaminants will not be discharged into the atmosphere. The kiln 13 is direct fired by a burner unit 21 which is positioned in the kiln 13 intermediate its material feed and discharge ends, 23 and 25, respectively.

The burner is normally fueled with oil or gas, and air is introduced adjacent the point of combustion. The amount of air and fuel introduced at the point of combustion is preferably monitored so that the burner 21 operates at substantially stoichiometric conditions; i.e., enough air is provided to effect substantially complete combustion of the oil or gas fuel.

Provision is made to admit auxiliary air into the kiln at the discharge end 25, as will be hereinafter described, in amounts required for certain modes of operation.

The ash or decontaminated matrix drops out of the discharge end 25 and is fed by a conveyor 27 to a rotary cooler 29 in which the decontaminated matrix is subjected to water sprays to reduce its temperature. A flap valve 31 is provided in the ash passageway ahead of the cooler 29 to minimize ingress of air into the system. Finally, the decontaminated matrix or ash is dropped onto a discharge conveyor 33.

In operating the kiln 13, sludge or liquids can be introduced at the material feed end 23 of the kiln 13 to effect their decontamination along with the solid feed. The amount of liquid or sludge that is fed in is controlled so that between the time the feed is introduced and the time that it reaches the burner unit 21 the liquid is evaporated and the solids contained therein are desorbed or pyrolyzed. The introduction of liquids and slurries in controlled amounts, along with solids, materially reduces entrainment of particulate matter in the off-gas when introduced at a position closely adjacent the material inlet.

The off-gas from the kiln 13 is conducted through a duct 35 to a secondary combustion unit 37. The secondary combustion unit 37 will be more fully described hereinafter but, in brief, it includes a burner section 39 into which the off-gas is conducted and in which it is subjected to high enough temperatures to effect destruction of the unwanted organics. To this end, a fueled burner and an excess of air are employed supplemented by the heating value of the off-gas.

Organic contaminants, such as PCB's, will be destroyed if the material is heated to a sufficiently high temperature and held for a given period of time (PCB's are assured of destruction if they are held at 2200° F. for two seconds) in an oxidizing atmosphere. The secondary combustion unit 37 also includes a vertically oriented holding section 41 through which the products of combustion pass to provide a holding time adequate to satisfy the destruction requirements of the most difficult materials.

From the holding section 41 the gases are directed through a cooling section 43 in the secondary combustion unit 37 in which water sprays 45 cool the gases and cause suspended particulate matter to fall into a sump 47 from which they are dewatered by suitable apparatus such as the dewatering screw 49 and conveyed to a storage point 51. The cooled gas, which may contain hydrogen chloride, sulfur dioxide, or the like, is then passed through a gas cleaning system 53 which is suitable to remove the contaminants. From the gas cleaning system 53, the gas is discharged into the atmosphere through a stack 54 by means of a blower 56. Since the system is essentially sealed, the blower 56 maintains a constant negative pressure in the entire system.

In the event that the secondary combustion unit 37 or any other major downstream processing equipment develops problems, an emergency oxidation unit is provided for the duct 35 as a safety measure. As will be described hereinafter, a burner is activated to oxidize the off-gas from the kiln and to discharge it into the atmosphere. Similarly, as will be described, a gas bypass unit 57 is provided for the secondary combustion unit 37 in the event that problems develop in the off-gas cleaning system 53.

As will be apparent, the kiln off-gas can be treated in other ways than by the system of the secondary combustion unit and the secondary combustion unit can be used with other sources of contaminated materials. However, the kiln 13, operated as described, and the secondary combustion unit 37, operating generally as described, form a highly efficient system when they are used together.

Figure 2:
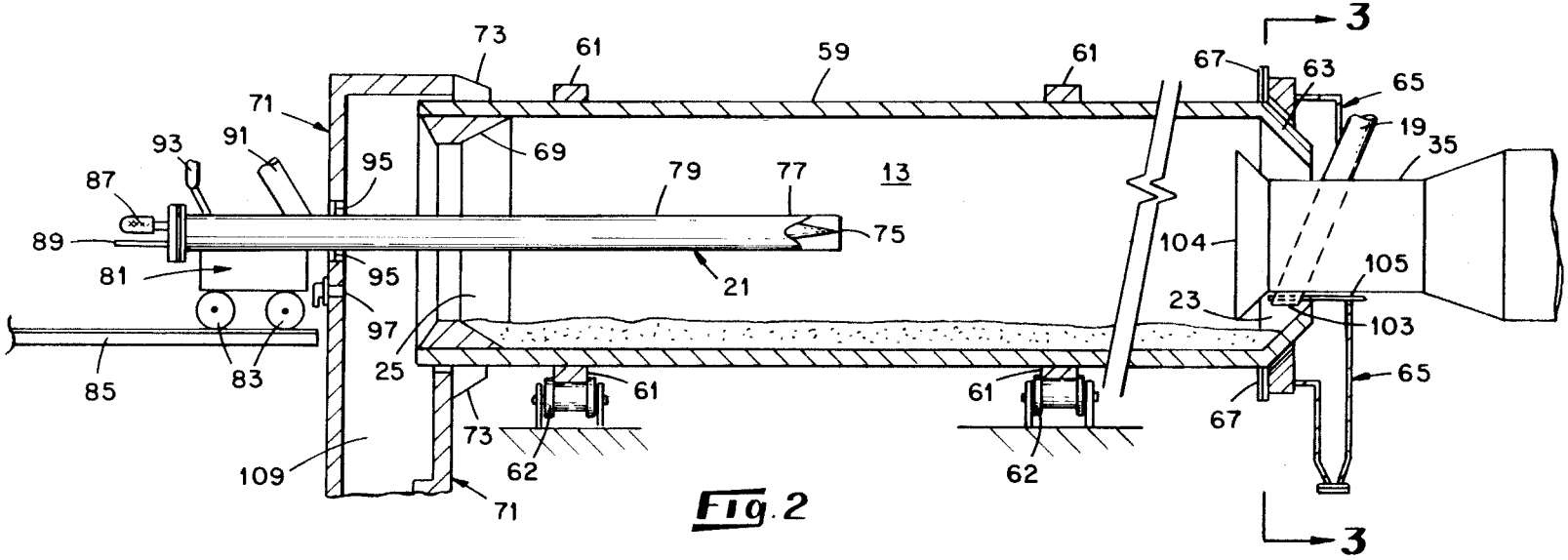
FIG. 2 is a sectional view of a kiln embodying various of the features of the invention.
Figure 3:
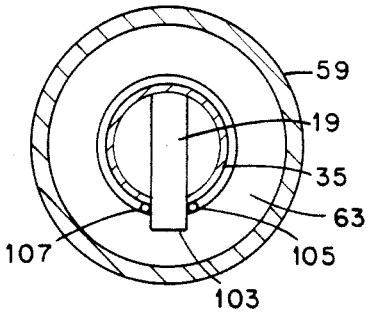
FIG. 3 is a sectional view taken along lines 3—3 in FIG. 2.
Figure 4:
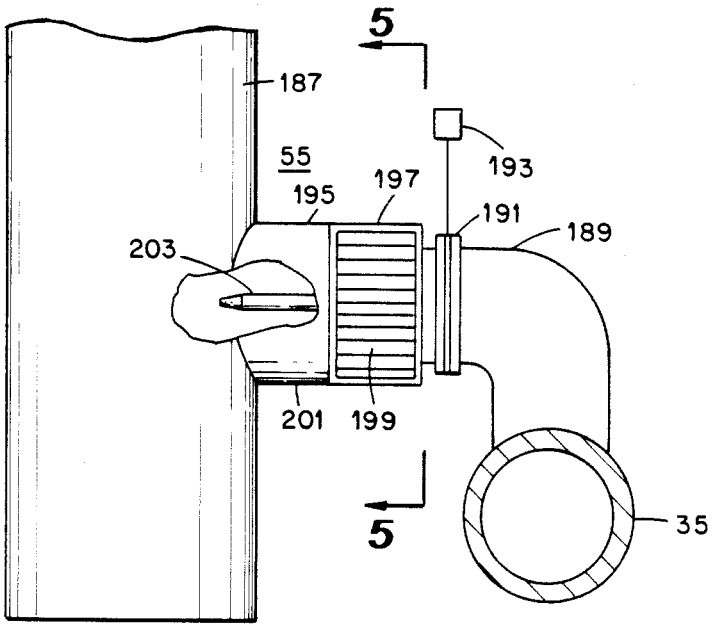
FIG. 4 is an elevational view, partially in section, illustrating an emergency, off-gas oxidizer which forms a part of the system shown in FIG. 1.

Now describing the kiln 13 in greater detail, with reference to FIGS. 2 and 3, the kiln 13 includes an elongated cylindrical shell 59 which includes a plurality of supporting rings 61 each of which is cradled on rollers 62 so that the shell 59 may be rotated around its longitudinal axis. The interior of the shell 59 is preferably lined with refractory or other material which will withstand the temperatures of about 1300° to 1800° F. which are to be employed and which will not be affected by the materials being processed or their by products. The longitudinal axis of the shell 59 slopes downwardly from the feed end 23 to the discharge end 25 so that material in the shell 59 will move from one end to the other incident to the rotation of the shell 59.

At the feed end 23, a dam 63 is provided around the interior of the shell 59 which prevents material fed into the shell 59 from falling out. An end closure 65 is provided which includes suitable seals 67 to minimize passage of air and gases. Since the shell 59 slopes towards the discharge end 25, a barrier ring 69 is provided around the interior of the shell 59 at its discharge end 25 to retard the discharge of material from the shell 59 as it is being rotated. The discharge end of the shell 59 fits within a casing 71 through which the ash or decontaminated matrix is directed to the ash conveyor 27 and rotary cooler 29 which have been described. Suitable seals 73 are provided between the casing 71 and the shell 59 to minimize air and gas flow through the joints. Of course, suitable motor means, not shown, are provided to rotate the shell 59.

As pointed out above, the kiln 13 is direct fired and employs counterflow gas movement. The burner unit 21 preferably includes a dual fuel burner 75 which is supported at the end 77 of an elongated tube 79 which is positioned generally axially of the shell 59 and extends into the shell 59 a distance which is determined by the characteristics of the materials being handled. Outside of the shell 59 and casing 71 a carriage 81 is provided which supports the burner tube 79 for movement into and out of the shell 59. The carriage 81 is supported upon wheels 83 which ride upon tracks 85 to position the burner 75 at the desired distance within the shell but other means may be provided to effect positioning of the burner 75 as desired. Fuel in the form of either a liquid fuel, e.g. oil, or a gaseous fuel, e.g. liquid petroleum gas or natural gas, is conducted to the dual fuel burner 75 through a fitting 87 which is connected to a conduit (not shown) that extends to the burner 75. Fittings 89, one of which is shown, provide for air and fuel connections to a pilot (not shown) which is located adjacent the burner 75. Combustion air for the burner 75 is supplied through conduit 91 and atomizing air, in the event that a liquid fuel is being employed, is supplied through conduit 93 which also extends to the burner. Suitable seals 95 are provided between the casing 71 and the burner support tube 79 to minimize the flow of air and gases at the point of insertion through the casing.

An auxiliary air inlet 97 is provided in the casing 71 to provide for the admission of air which can provide higher levels of oxygen in the area in the shell 59 between the burner 75 and the casing 71.

At the feed end 23 of the kiln 13, the off-gas duct 35 extends through the end closure 65 and into the discharge end of the shell 59 (see FIGS. 2 and 3). The inner end of the duct 35 is provided with a flared inlet 104. The feed of solid matrices and matrices which do not contain enough liquid to be readily pumpable is effected though the feed conduit 19 which extends through the end closure 65 and through the duct 35 to a point 103 inside of the dam 63 at the feed end 23 of the kiln 13 and behind the flared inlet 104 on duct 35. In addition, inlets for liquid and slurry, 105 and 107, respectively, are provided through the end closure 65 on opposite sides of the feed conduit 19 and behind the flared inlet to the off-gas duct 35. It has been found that this positioning minimizes the tendency of particulate matter to be carried out of the kiln 13 with the off-gas since the large diameter off-gas duct 35 together with its flared inlet 104 minimize turbulence at the feed end 23 and the flared inlet 104 acts as a shield to minimize entrainment of feed materials from the conduit 19, and liquid and slurry inlets 105 and 107.

The kiln 13 illustrated does not include interior flights for raising the material being treated as the kiln 13 is rotated, but the usual type of flights may be employed if it is found desirable under operating conditions.

As an example, the kiln shell 59 may be approximately 45 to 50 feet in length and approximately 7 to 8 feet in diameter. The burner support tube 79 is sufficiently long so that it can be extended into the shell 59 about 12 feet or about 25 percent the shell's length although greater or lesser lengths may be employed.

As pointed out above, the materials, which require treatment in the decontamination of hazardous organics, vary from site to site as do the amounts or proportions that are contained in the material or matrix. For example, soil may be contaminated with PCB's in an amount measured in parts per million. On the other hand, the matrix material may be sand which is contaminated with large amounts of oil or tar, e.g. 20 percent or more. In each instance it is necessary to treat the off-gas produced when the matrix is heated to vaporize, desorb or pyrolyze the hazardous organics from the matrix. It is desirable that the volume of off-gas is minimized in order to conserve the amount of auxiliary fuel which is required for an after-burning step and/or to reduce the size of any after treatment equipment to a minimum.

In normal operation of a direct fired, countercurrent kiln, the amount of combustion air provided for the burner usually is from 150° to 200 percent of the stoichiometric amount required for combustion. This results in a large volume of off-gas requiring treatment. Moreover, if there is a substantial proportion of organic material in the matrix, e.g., matrices containing oils, tars or the like, these products become oxidized in the kiln 13 and greatly increase the amount of off-gas requiring treatment.

In the case of direct fired burners, most of the heat is transferred by radiation so that the temperature gradient along the length of the kiln 13 drops rapidly as the position in the kiln 13 is more distant from the burner. In the kiln 13 of this invention, it is apparent that the position of the burner 75 can be varied longitudinally along the length of the kiln 13 which makes it possible to provide the proper temperature gradient for drying, desorption and pyrolysis for a wide variation of material. In addition, the material remaining after desorption will "soak" at a relatively high temperature between the position of the burner 75 in the kiln 13 and the discharge point for the material. If there is oxygen present in this area, any organic contaminants which are not desorbed will be oxidized since they are maintained at a high temperature, e.g. 1300°–1800° F. for an extended period of time, thus, insuring that the matrix or ash which is discharged will be free of contaminants.

In the case of, for example, the processing of sand which contains a small amount of a hazardous organics, in which the burner 75 is operated with approximately the stoichiometric amount of air for the combustion of the fuel, there normally will be sufficient oxygen present in the area between the position of the burner 75 and the discharge end of the kiln 13 to effect the oxidation of any residual organics because of leakage through seals and the like. On the other hand, if there is a substantial amount of organic material present, e.g., a large proportion of oils or tars, the air supplied to the burner 75 is desirably held to an amount which will burn the fuel but will not supply enough oxygen to support the combustion of the oil or tar contaminants. This will provide a reductive atmosphere in the zone between the burner 75 and the discharge end of the kiln 13. This atmosphere will not permit any substantial oxidation or combustion of the organic materials but, instead, they will retain their heating value which can be employed to minimize fuel usage in a subsequent combustion step. Under these conditions, organics remaining in the matrix between the burner 75 and the discharge end of the kiln 13 will not oxidize. In order to oxidize these materials, air is admitted through the auxiliary air inlet 97 in sufficient amount to provide an oxidizing atmosphere in the area between the material discharge end of the kiln 13 and the burner 75. The amount of air admitted is preferably a controlled amount sufficient to provide an oxidizing atmosphere but not enough to convert the reductive atmosphere in the kiln between the burner 75 and the feed end of the kiln 13. This permits the desorbed and pyrolyzed organics to retain fuel value for subsequent treatment.

Positioning of the burner 75 at various points along the length of the kiln 13 is also employed to produce temperature gradients which can be employed to maximize the capacity of the kiln 13. For example, in the case where the hazardous organic is to be removed from a sand whose particles do not absorb the contaminate, the "soaking" zone can be shortened by moving the position of the burner 75 back towards the discharge end, thereby increasing the through-put of the material being treated. On the other hand, if the contaminant is difficult to remove, the burner 75 can be positioned in its most inward position to extend the "soaking" zone to its maximum length.

In any event, operating at about the stoichiometric amount of air for the fuel required, e.g., less than about a twenty percent excess, the volume of off-gas produced is greatly reduced as compared with the volume of off-gas produced in a normal direct fired kiln operation. In addition, the provision of the soaking zone between the burner 75 and the discharge end of the kiln 13 assures complete decontamination of the material being treated. Thus, depending upon the nature of the feed materials, the amount of air admitted through auxiliary inlet 97 is controlled to maintain the oxidizing/reductive interface at the optimum location that promotes maximum treatment capacity and treated material quality.

The secondary combustion unit 37, which is illustrated in FIGS. 6A and 6B includes the burner section 39, the holding section 41 and the cooling section 43.

The burner section 39 includes two zones, an upper, primary combustion zone 111 and a lower secondary combustion zone 113. The primary combustion zone 111, illustrated, is cylindrical in shape and has a lower open end 115 which communicates with the secondary combustion zone 113. The secondary combustion zone 113 is defined by upper and lower conical surfaces 117 and 119, respectively, which are interconnected by an intermediate cylindrical surface 121.

The burner section 39 is adapted for high temperature operations, e.g. 2200°-3000° F., so the interior is lined with refractory walls 123 which are supported in the usual manner known in the art by suitable structural members.

The off-gas duct 35 from the kiln 13 connects with an off-gas inlet 125 which communicates with an annular plenum 127 which surrounds the walls of the primary combustion zone 111. The plenum 127 and the inlet 125 are preferably lined with refractory 129. Passageways 131 from the off-gas plenum 127 communicate with the primary combustion zone 111, these passageways 131 being radially directed towards the center of the zone 111. In FIG. 6A only one of the passageways 111 is shown, however, preferably four are provided which are located at intervals of 90° around the primary combustion zone.

In the upper end of the primary zone 111 there is located a burner 133 which is fueled by oil or gas and which has the capacity to raise the temperature in the burner section 39 to approximately 2200° to 3000° F. The burner 133 is provided with a pilot 135 for igniting the fuel from the burner 133 in accordance with usual practice. Primary combustion air, from a source of pressurized air (not shown), for the burner 133 is provided through an inlet duct 137 which communicates with an annular plenum 139 whose inner wall 141 is provided with openings 143 which permit air to flow around the burner 133 and through the opening 145 into the primary combustion zone 111.

Secondary air under pressure for the primary combustion zone 111 is provided through an inlet 147 which communicates with a plenum 149 which extends around the primary air plenum 139. An annular passageway 151 is provided around each of the off-gas passageways 131, the passageways 151 communicating with the plenum 149 so that secondary air is admitted around each of the off-gas streams flowing from the passageways 131 which are directed radially into the primary combustion zone 111.

Also communicating with the off-gas plenum 127 through the wall 117 are a plurality of down draft, off-gas passageways 153 which are directed into the secondary combustion zone 113, downwardly at an angle of about 35° from the horizontal (angle "a" in FIG. 7). The passageways 153 are also oriented at an angle of about 20° relative to a radius 154 of the secondary combustion zone 113 (angle "b" in FIG. 7) in a direction which will effect counterclockwise rotation of the gas in plan view (looking down in the secondary combustion zone 113). Although only one of the passageways 153 is illustrated in FIG. 6A, four are provided which are, preferably, equally spaced around the secondary combustion zone 113.

Combustion air for the down draft passageways 153 is provided by a tertiary air inlet 155 which communicates with an annular, tertiary air plenum 157 which extends around the secondary combustion zone 113. The tertiary air plenum 157 communicates with annular passageways 159 around each of the down draft off-gas passageways 153 to deliver combustion air around each of the off-gas passageways 153. In FIG. 6A, only one of the down draft passageways 153 is shown; however, a plurality are provided, preferably four.

Contaminated waste liquids can be introduced into the unit in both the primary and secondary zones 111 and 113. In the primary zone 111 an opening 161 is provided in the refractory in the upper section of the walls of the zone through which is inserted a waste liquid nozzle 163 through which the contaminated liquid can be sprayed into the primary combustion zone 111. In addition, four waste liquid injection nozzles 165, one of which is shown in FIG. 6A, extend through the conical wall 117 of the secondary combustion zone 113. These nozzles 165 are downwardly directed at an angle of about 30° to the horizontal and are directed radially into the secondary combustion zone 113. Four of these nozzles 165 are arranged as shown in FIG. 8.

Quench water nozzles 167 are equally spaced about the periphery of the secondary combustion zone 113 and are directed horizontally into that zone and oriented at an angle about 20° relative to a radius 168 of the secondary combustion zone 113 (angle "c" in FIG. 8) to correspond to the rotative path of the gases in the secondary combustion zone 113.

It should be noted that the angles given for the down draft passageways and the quench water nozzles 167 are not critical. Any suitable set of angles may be employed which will effect a downward and rotative movement in the zone 113.

In the event that the temperature in the primary and secondary combustion zones 111 and 113 exceeds predetermined limits, quench water can be sprayed through the nozzles 167 to decrease the temperature. Also, to provide a less drastic control of temperature, the volume of air from the passageways 159 may be increased to cool the zone. Moreover, lightly contaminated water (e.g. less than about 1 to 2 percent organics) may be injected through the nozzles 167 to create a capacity to dispose of contaminated purge water and the like while creating a heat sink to control temperature, thereby reducing the volume of cooling air required through the passageway 159.

It is apparent that the arrangement of the nozzles 167 and the air and off-gas passageways 153 together with the shape of the chamber will result in extreme turbulence throughout the zones 111 and 113. Thus, all of the particles, gases and vapors in the chamber will be subjected to a substantially uniform high temperature which will effect the destruction of the unwanted organics.

As pointed out above, certain of the unwanted organics require a holding time at temperature in order to assure complete destruction. To this end, an elongated cylindrical holding section 41 is connected to the opening in the bottom of the lower conical section 119. The holding section 41 includes a conical upper end 169 which corresponds in shape to the lower conical section 119 of the secondary combustion zone 113. The conical section 169 is connected to an elongated cylindrical section 171 which provides sufficient volume to maintain the gases and suspended solids at the proper temperature for the desired period of time. The bottom of the holding zone is in the form of a conical section 173 which corresponds in shape to the conical section 169. The holding section 41 is desirably lined with refractory (not shown) because of the high temperatures that are involved and is preferably a hollow section without baffles or other mixing devices so as to minimize the build-up of particulate on the wall. Such build-up is minimized by the vortex action induced into the hot gases by the down draft passageways 153 and the shape of the secondary combustion chamber 113.

Now referring to FIG. 6B, the lower end of the lower conical section 173 is connected to the cylindrical cooling section 43 which includes through its walls a plurality of water sprays 45 which cool the heated gases to a temperature at which they can be further processed. In the illustrated embodiment two rows, 175 and 177, of water nozzles are provided, each of the rows in the preferred embodiment having six nozzles which are circumferentially spaced around the section 43. The upper row of the nozzles 175 are arranged to spray approximately 15° downwardly from the horizontal and the lower row of nozzles 177 is adapted to spray inwardly in a horizontal plane. Both sets of nozzles are adapted to be arranged at an angle of about 20° to the radii of the cooling section (angle "d" in FIG. 9) to effect counterclockwise rotation in the manner which has been described above. The orientation and position of the nozzles is shown in FIG. 9.

The sprayed cooling water falls into the sump 47 in which the solids settle so that they can be withdrawn through a discharge opening 179 and dewatered as by the dewatering screw 49 in FIG. 1. The cooled gases exit through the cooled gas outlet 181 in the sump 47 through an outlet duct 183 to the gas cleaning system 53 from which the clean gases are discharged through a stack 54 by means of the blower 56. In order to conserve cooling water, water from the sump 47 is drawn through line 220 by pump 221 which discharges the water through line 222 into a treatment unit 223. In the treatment unit 223 particulates are removed and acidic components are neutralized. From the unit 223 the treated water is pumped through lines 224 and 225 by pump 226 to the rows of nozzles 175 and 177.

Figure 5:
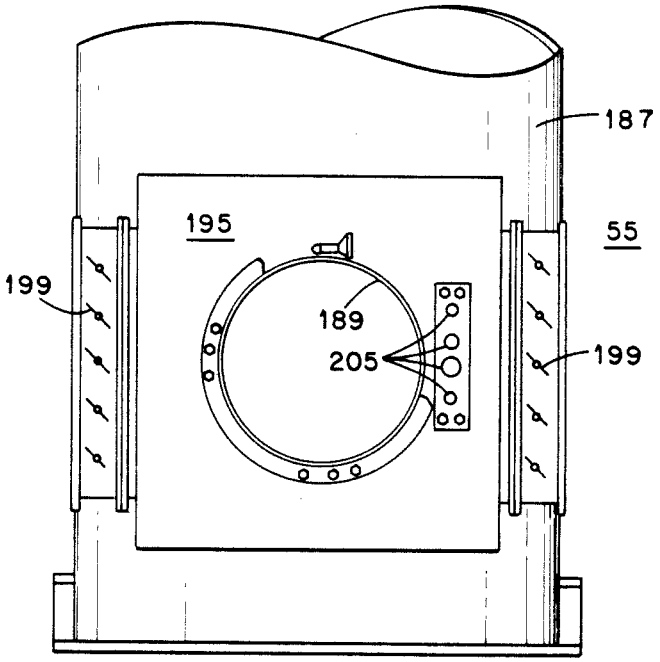
FIG. 5 is an elevational view taken along lines 5—5 in FIG. 4.

In the event that the secondary combustion unit 37, the cooling section 43 or the gas cleaning system 53, develops problems, an emergency oxidizer 55 is provided in the duct 35 between the kiln 13 and the secondary combustion unit 37. This includes a stack 187 which is located adjacent the duct 35 and which is tall enough to disperse the products of combustion. Gases are conducted from the duct 35 through an elbow 189. A slide valve 191 which includes a pneumatic actuator connects the elbow 189 to a plenum 195 which includes an air inlet section 197 having louvers 199 on either side thereof. The plenum is connected by a section of duct 201 to the base of the stack 187. A burner 203 fired by oil or gas is mounted in the duct 201. As shown in FIG. 5, the fuel and air to the burner are provided through the openings 205. In the event of problems with the secondary combustion unit or other major downstream equipment, the burner 75 in the kiln 13 reverts to low fire, all feeds are stopped, the actuator 193 opens slide valve 191, and burner 203 is ignited. Air for combustion is drawn in through the louvers 199 and the action of the burner 203 and the stack 187 causes the residual off-gas from the kiln 13 to be drawn past the burner 75 where organics are oxidized and carried up the stack 187.

As has been pointed out, a gas by-pass unit is connected to the sump 47. This is employed if the gas cleaning unit 53, the burner section 39, or the cooling section 43, develop problems. The sump 47, above the liquid level, is connected by a slide valve 207 having a pneumatic actuator 209 to a duct 211 which connects with a stack 213. The stack 213 is provided with a mist eliminator 215 to minimize the passage of liquid up the stack 213. In the event of shut-down of the above material systems, the slide valve 207 is opened and the gases from the secondary combustion unit 113 are vented through the stack 213 to the atmosphere by an in line fan 210.

In operation, the materials to be decontaminated are broken up into the desired size to provide for desorption of the unwanted organics. The materials are fed into the kiln 13 which is maintained at a temperature of from 1300° to 1800° F. with the materials in the oxidizing zone being maintained at about 1300° F. and the off-gas being at a temperature of about 1300° F. The material 15 is fed into the kiln 13 at a rate such that the time in the reducing and oxidizing zones is sufficient to insure that unwanted organics are desorbed and that any remaining organics are oxidized before the ash is discharged. To this end, the position of the burner 75 may be adjusted along the length of the kiln 13 to tailor the temperature gradient in the kiln 13 to the material being treated as well as to vary the proportional time the material is held in the oxidizing and reducing zones. The ash is discharged at a temperature of about 1300° F.

The off-gas is conducted to the burner section 39 of the secondary combustion unit 37 wherein the heat supplied from the burner 133 is supplemented by the heating value of the desorbed and oxidized organics. The temperature in the burner section 39 is maintained at about 2200° F. with an appropriate excess of oxygen. The combustion gases pass down through the holding section 41 and are cooled in the cooling section 43 whereupon they are passed into the gas cleaning section 53. Particulates from the sump are dewatered and held in the storage area 51. Purge water from the gas cleaning system is passed through conduits 215 into the ash conveyor through the conduit 217 and into the rotary cooler 29 and/or through the conduit 219 depending on the cooling requirements.

Because of the atmosphere control of the thermal treatment process in the kiln 13, a minimum amount of off-gas is produced in the kiln 13 as compared to the condition wherein the organic material is completely oxidized. This makes it possible to reduce the amount of off-gas passed into the secondary combustion unit 113 which results in lower off-gas velocities with a consequent reduction in the entrainment of particulates from the kiln 13. This allows higher treatment capacities for the equipment. Capacity and performance can be further increased by the utilization of oxygen enriched air for kiln burner unit 21 so as to minimize the volume of off-gas generated in the kiln 13.

Because of the construction of the system, which includes a minimum amount of mechanisms, it is possible to break the unit into modules which can be readily transported.

Various of the features of the invention believed to be new are set forth in the appended claims.

What is claimed:

1. The method of removing unwanted organic materials from a matrix in a countercurrent, direct fired, rotary kiln having a burner which is selectively positionable along the length of said kiln, comprising the steps of feeding the matrix into one end of said kiln and discharging the treated matrix from the other end of said kiln, delivering hydrocarbon fuel to the burner together with sufficient air at the point of combustion to essentially only effect combustion of the fuel to maintain the kiln at a temperature at from about 1300°-1800° F. and develop a substantially non-oxidizing material treatment environment between said burner and the point of entry of said matrix into said kiln, conducting off-gas from the kiln at its matrix feed end to a subsequent treatment means, positioning the burner at a selectable location along the length of said kiln spaced from the feed end a sufficient distance to dry, desorb, and pyrolyze substantially all of said unwanted organic materials by the time they reach the position of said burner and further defining a second material treatment zone between said burner and said discharge end, and admitting auxiliary air to said second material treatment zone thereby maintaining an oxidizing atmosphere in the area of said kiln between said burner and the discharge end of said kiln whereby the volume of combustion air and auxiliary air is less than enough to completely oxidize said unwanted organic materials that have been evaporated, desorbed or pyrolyzed and retaining the matrix in said material treatment zone a sufficient period of time to oxidize any remaining organic materials prior to discharge from said kiln.

2. The method of claim 1 wherein the off-gas treatment includes raising its temperature from about 2200° to about 3000° F. in the presence of an excess of air for a period of time sufficient to effect destruction of any unwanted organic materials.

3. the method of claim 1 wherein organic materials in the off-gas are burned with an excess of air and sufficient auxiliary hydrocarbon fuel to achieve the required temperature.

* * * * *